US005743223A

United States Patent [19]

Spengel et al.

[11] Patent Number: 5,743,223

[45] Date of Patent: Apr. 28, 1998

[54] BUCKET TAPPET GUIDE

[75] Inventors: Christoph Spengel, Grossbettlingen; Uwe Matena, Backnang; Christoph Kugel, Stuttgart, all of Germany

[73] Assignee: Mercedes-Benz AG, Stuttgart, Germany

[21] Appl. No.: 863,859

[22] Filed: May 27, 1997

[30] Foreign Application Priority Data

May 28, 1996 [DE] Germany ..... 196 21 318.5

[51] Int. Cl.[6] ..... F01L 1/00; F02F 1/00

[52] U.S. Cl. ..... 123/90.48; 123/193.5

[58] Field of Search ..... 123/90.27, 90.48, 123/90.5, 90.51, 193.5, 193.3

[56] References Cited

U.S. PATENT DOCUMENTS 5,113,811 5/1992 Rembold et al. ..... 123/90.48

5,365,897 11/1994 Speil et al. ..... 123/90.48

FOREIGN PATENT DOCUMENTS 38 02 659 4/1989 Germany .

*Primary Examiner*—Weilun Lo

*Attorney, Agent, or Firm*—Klaus J. Bach

[57] ABSTRACT

In a bucket tappet guide structure for a valve tappet of an internal combustion engine having a bucket tappet slideably disposed in a tappet receiving bore, wherein the tappet has a chamfered front end providing for a tappet front face having a smaller diameter than the tappet body, a guide bore is disposed in front of the tappet bore and concentric therewith, the guide bore having a diameter which is larger than the diameter of the tappet bore, however by less than the difference between the diameter of the tappet body and the tappet front face so as to facilitate insertion of the bucket tappet into the tappet bore.

3 Claims, 1 Drawing Sheet

BUCKET TAPPET GUIDE

BACKGROUND OF THE INVENTION

The invention relates to a bucket tappet guide for the bucket tappet of the lifting valve of a valve-controlled reciprocating-pistons internal combustion engine.

A conventional bucket tappet guide (see, for example, DE C 38 02 659) consists of a reception bore in the cylinder head or in the camshaft housing sized to guide the bucket tappet in the reception bore essentially free of play. In order to make it easier to slip the bucket tappet into the reception bore in an automated assembly line, both the lower edge of the bucket tappet and the upper edge of the reception bore are chamfered. It nevertheless happens repeatedly that the bucket tappets become tilted and jammed when they are being slipped into the reception bore. The automated operation is thereby interrupted, and it is necessary to carry out additional manual work which is costly and, in view of the short cycle times of the assembly line, presents big problems.

The object of the invention is to provide a bucket tappet guide which ensures that the bucket tappet is reliably slipped into the reception bore.

SUMMARY OF THE INVENTION

In a bucket tappet guide structure for a valve tappet of an internal combustion engine having a bucket tappet slideably disposed in a tappet receiving bore, wherein the tappet has a chamfered front end providing for a tappet front face having a smaller diameter than the tappet body, a guide bore is disposed in front of the tappet bore and concentric therewith, the guide bore having a diameter which is larger than the diameter of the tappet bore, however by less than the difference between the diameter of the tappet body and the tappet front face so as to facilitate insertion of the bucket tappet into the tappet bore.

With the arrangement according to the invention, the bucket tappet is first slipped into the guide bore, this being easily possible because its diameter is somewhat larger than the diameter of the tappet bore. In the guide bore, the bucket tappet is pre-centered, so that it can then slide guided by the chamfered end of the tappet into the tappet bore without tilting.

It is advantageous to provide the edge of the guide bore with a chamfer which, together with the chamfer on the lower edge of the bucket tappet, insures that the bucket tappet is reliably inserted into the guide bore.

If a relatively long guidance of the bucket tappet in the guide bore is desired, the wall surrounding the guide bore extends upwardly so that it projects above the bucket tappet when the tappet is actuated for opening an associated valve. In this case, this wall is provided with two diametrically opposite recesses extending in the direction of rotation of a cam actuating the bucket tappet allowing the cam to move through the recesses for operating the bucket tappet.

An exemplary embodiment of the invention is described below with reference to the drawing.

DESCRIPTION OF A PREFERRED EMBODIMENT

Figure 2:
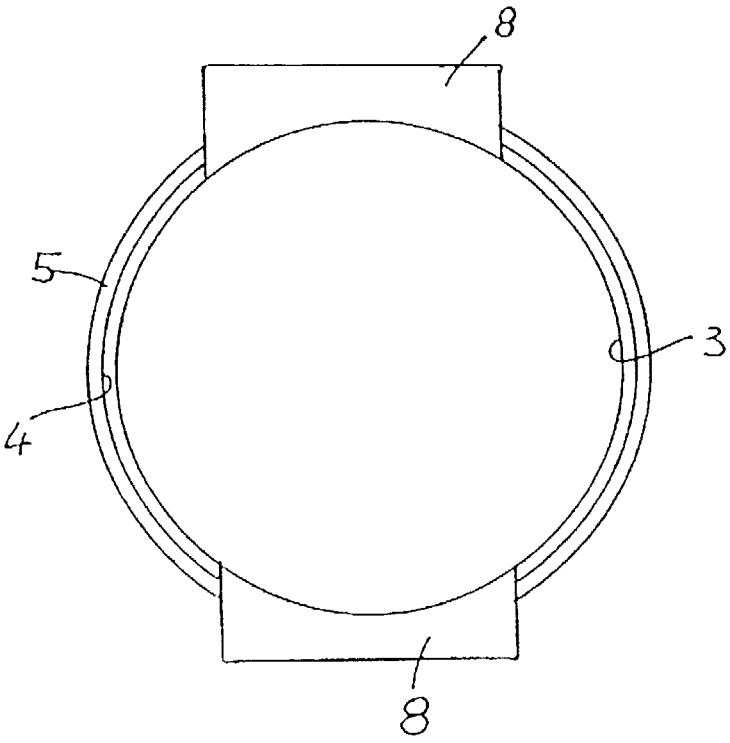
FIG. 2 is a top view of the guide bore region of the cylinder head.
Figure 1:
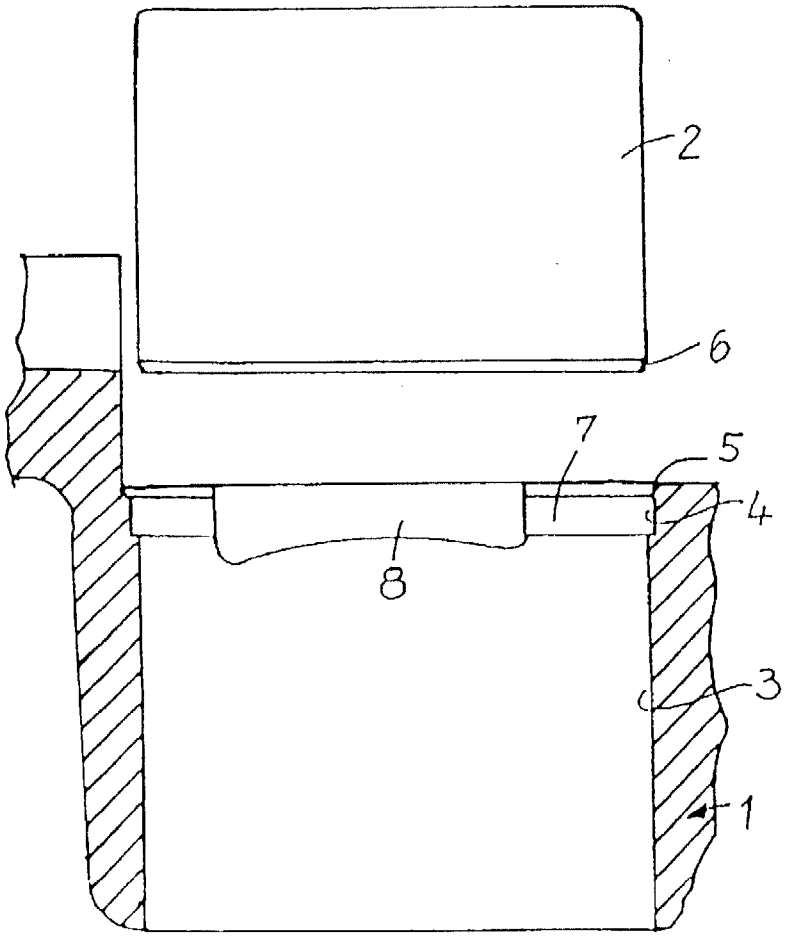
FIG. 1 shows a section through a cylinder head or camshaft housing in the region of a bucket tappet guide bore and a bucket tappet which is positioned to be slipped into the tappet guide bore.

The numeral 1 denotes a cylinder head (or a camshaft housing) of a valve-controlled reciprocating piston internal combustion engine. The cylinder head 1 includes a bucket tappet guide for each valve (not shown) actuated by a cam via a bucket tappet 2. The bucket tappet guide consists of a tappet bore 3 slideably receiving the bucket tappet 2 with a close fit. A guide bore portion 4 is arranged in front of the tappet bore 3 and is concentric relative to the latter. It has a diameter which is slightly larger than the diameter of the tappet bore 3, for example, by 0.04 mm. For clarification, this difference in diameter is greatly exaggerated in the drawing. The guide bore 4 is provided at the upper edge with a chamfer 5. Because of the somewhat larger diameter of the guide bore 4 and the chamfer 5, insertion of the bucket tappet 2 into the tappet bore 3 by automatic manufacturing equipment without cogging and jamming is greatly facilitated. The tappet is generally provided with a chamfer 6 formed at its lower edge so that the front face of the tappet has a diameter smaller than the body of the tappet by a certain length. The guide bore 4 has a diameter somewhat larger than that of the tappet bore 3 by an amount which is smaller than the certain length by which the diameter of the tappet body exceeds the diameter of the tappet front face. In the guide bore 4, the bucket tappet 2 is pre-centered relative to the tappet bore 3 so that it can then be easily inserted into the tappet bore 3. In order to insure good pre-centering of the tappet bucket the guide bore 4 may be so long that, when an associated valve is opened, that is to say, when the bucket tappet 2 is pushed fully into the tappet bore by a cam operating the tappet, the surrounding wall 7 projects above the bucket tappet. In order to allow the cam to operate the tappet, this wall is provided, in the direction of rotation of the cam, with two diametrically opposite recesses 8 which are shaped so as to accommodate the cam.

What is claimed is:

1. A bucket tappet guide structure for a valve tappet of a valve controlled reciprocating piston internal combustion engine having a tappet receiving bore in which a bucket tappet is slideably supported with a close slide fit, said tappet bucket having a chamfered front end providing for a tappet front face having a diameter smaller than the diameter of the tappet body and said tappet guide structure having, in front of said tappet bore, a guide bore which is concentric relative to said tappet bore and has a diameter which is larger than the diameter of the tappet bore by less than the difference between the diameter of said tappet body and the diameter of the tappet front face.

2. A bucket tappet guide structure according to claim 1, wherein said guide bore has a chamfered top edge.

3. A bucket tappet guide structure according to claim 1, wherein recesses are provided in the wall around said guide bore so as to extend in the direction of rotation of the cam actuating the bucket tappet, said recesses being disposed diametrically opposite one another for accommodating a cam operating said bucket tappet.

* * * * *